US009280871B2

(12) United States Patent
Bailey et al.

(10) Patent No.: US 9,280,871 B2
(45) Date of Patent: Mar. 8, 2016

(54) GAMING SYSTEMS WITH AUTHENTICATION TOKEN SUPPORT

(75) Inventors: Daniel Vernon Bailey, Pepperell, MA (US); Burton S. Kaliski, Jr., Wellesley, MA (US); Ari Juels, Brookline, MA (US); Ronald L. Rivest, Arlington, MA (US)

(73) Assignee: EMC Corporation, Hopkinton, MA (US)

( * ) Notice: Subject to any disclaimer, the term of this patent is extended or adjusted under 35 U.S.C. 154(b) by 2515 days.

(21) Appl. No.: 11/774,857

(22) Filed: Jul. 9, 2007

(65) Prior Publication Data

US 2008/0009345 A1 Jan. 10, 2008

Related U.S. Application Data

(60) Provisional application No. 60/819,197, filed on Jul. 7, 2006.

(51) Int. Cl.
*G07F 17/32* (2006.01)

(52) U.S. Cl.
CPC ..... *G07F 17/3251* (2013.01); *G07F 17/32* (2013.01)

(58) Field of Classification Search
CPC ..... G07F 17/3251; G07F 17/32
USPC ..... 463/29, 43
See application file for complete search history.

(56) References Cited

U.S. PATENT DOCUMENTS

| | | | | |
|---|---|---|---|---|
| 4,720,860 | A | 1/1988 | Weiss | |
| 5,168,520 | A | 12/1992 | Weiss | |
| 5,361,062 | A | 11/1994 | Weiss et al. | |
| 2004/0092311 | A1* | 5/2004 | Weston et al. | 463/42 |
| 2007/0143624 | A1* | 6/2007 | Steeves | 713/182 |
| 2007/0192849 | A1* | 8/2007 | Golle et al. | 726/16 |

OTHER PUBLICATIONS

U.S. Appl. No. 11/671,264, filed in the name of D.V. Bailey et al. Feb. 5, 2007 and entitled "Wireless Authentication Methods and Apparatus".

U.S. Appl. No. 11/530,655, filed in the name of D.V. Bailey et al. Sep. 11, 2006 and entitled "Tokencode Exchanges for Peripheral Authentication".

* cited by examiner

*Primary Examiner* — Jasson Yoo
(74) *Attorney, Agent, or Firm* — Ryan, Mason & Lewis, LLP

(57) ABSTRACT

Techniques for providing authentication functionality in a gaming system are disclosed. In one aspect, a gaming system is configured such that, at a given point during a current session of a game in progress that involves at least one user previously granted access by the system to participate in the current session, information available from an authentication token associated with the user is obtained prior to allowing the user to take a particular action in the game. A determination is made as to whether or not the user will be allowed to take the particular action in the game, based on the obtained information. The obtained information may comprise, for example, at least a portion of a one-time password generated by a hardware or software authentication token.

29 Claims, 2 Drawing Sheets

GAMING SYSTEMS WITH AUTHENTICATION TOKEN SUPPORT

RELATED APPLICATION(S)

The present application claims the priority of U.S. Provisional Patent Application Ser. No. 60/819,197, filed Jul. 7, 2006 and entitled "Gaming Systems with Authentication Token Support," the disclosure of which is incorporated by reference herein.

FIELD OF THE INVENTION

The present invention relates generally to authentication techniques, and more particularly to providing improved authentication in gaming contexts.

BACKGROUND OF THE INVENTION

Millions of people now spend part of their day in a virtual world, also commonly referred to as a synthetic world. They may work and play in a magical fantasy that exists only in a remote server farm and in their own minds. In these worlds, programmers can become wizards, accountants can become warriors, and college students can explore the stars. From auto racing to everyday life to medieval times there is a virtual world environment available to meet any taste.

Perhaps this should come as no surprise. As personal computers (PCs) and gaming consoles proliferate, more people play videogames. From a humble but addictive origin in Pong and its countless imitators a video game industry has emerged to suit a wide variety of tastes from casual games offering simple puzzles to elaborate immersive adventures with detailed stories that unfold over hundreds of hours of gameplay. These adventure games in particular often employ a wide cast of characters whose actions and dialogue are carefully scripted by the game designer.

But even the best scripted characters can't match the experience of interacting with real people. It would appear that all types of games including card games and board games are more enjoyable when played socially instead of alone. With this in mind, it seems inevitable that as our gaming consoles and PCs gained broadband connectivity, social games would follow. The tremendous increase in connectivity and processing has led to online games that go far beyond the traditional four- to six-player board game to include communities sometimes numbered in the millions.

Most of the popular virtual worlds we see including World of Warcraft and EverQuest offer in-game rewards for time spent playing the game. A player controls a persistent character with certain attributes like strength and speed and certain equipment including weapons and armor. One can increase one's abilities and improve one's equipment through completing quests or successfully battling scripted computer-controlled characters. Increasing one's attributes in this way can allow one's character to perform more powerful actions. For instance, a wizard may need to attain Level 20 before he or she can cast fireballs at enemies. Naturally, some people play these games quite a lot and gain very powerful skills and equipment merely by playing the game.

Some people may want these things without investing all that time. Clearly, these items have value to these players. No further proof of this fact is needed than to consult listings on eBay for in-game artifacts and characters. Reliable statistics are hard to come by, but estimates on the size of this market exceed $100 million annually in the U.S. with greater trade seen in Asia. Some individual artifacts like swords have sold for thousands of dollars.

Paying $1000 for a sword that is, after all, really a mere pile of bits seems absurd unless one recalls the actual labor involved in its attainment. In spite of this, it can be argued that the value of such a thing is fleeting at best: a game designer could easily decide that these swords will become widespread and easily available. While this is no doubt true, the same can be said of any floating currency including the U.S. dollar. The U.S. Treasury does not wantonly increase the world's supply of dollars because doing so would drive down their value. Similarly, game designers have an interest in rewarding their most dedicated players and inspiring ordinary players to become dedicated.

It seems that both players and game designers want to maintain the linkage between time spent playing the game and wealth earned. Given the secondary market in virtual equipment, it should come as no surprise that players have attempted to automate the gathering of status and items. Since most players of these games use ordinary PCs to access the virtual world, many have experimented with automated scripts to mimic the presence of a human playing the game and accumulating treasure.

Combating the abuse of automated scripts is a concern not only of online game designers but also web sites that offer free e-mail accounts and those that sell tickets to coveted events. In general, the problem can be stated as: how can a remote computer program determine if it is interacting with a human rather than another program? This problem is a variant on the celebrated Turing test in which a human judge interacts electronically with both a human and a computer and attempts to determine which is which.

Determining if a human is present is of course a part of a larger authentication problem: how can a remote computer program determine if it is interacting with the correct human? Most online systems including online games use the venerable combination of username and password at login time to establish confidence in a user's identity. But it has long been known that passwords are problematic: users forget them, choose them badly, and guard them poorly. Given that we have established that these accounts hold goods with substantial real-world value, better alternatives to static passwords need to be considered. Identity theft is a growing problem and online games are not immune.

Accordingly, what is needed is a solution that addresses both user authentication and verification of user presence. The corresponding security measures should be easy to use and unobtrusive. Otherwise, users will simply bypass them. Moreover, the solution should be culturally appropriate to a given virtual world. That is, it should look to enhance rather than degrade the experience of playing these games.

SUMMARY OF THE INVENTION

The present invention in one or more of the illustrative embodiments described herein meets the above-identified need by providing techniques which allow a gaming system to obtain information available from an authentication token at various points during a game in progress. Such an approach can be used not only to provide user authentication, but also to ensure that there is an actual human user present, thereby limiting system attacks involving the use of automated scripts.

In accordance with one aspect of the invention, a gaming system is configured such that, at a given point during a current session of a game in progress that involves at least one user previously granted access by the system to participate in the current session, information available from an authentication token associated with the user is obtained prior to allowing the user to take a particular action in the game. The particular action may be, for example, casting a spell, opening a locked door or chest, obtaining an item, achieving a specified credential, entering a designated area, or otherwise accessing a particular element within a virtual world provided by the game in progress. A determination is made as to whether or not the user will be allowed to take the particular action in the game, based on the obtained information. The obtained information may comprise, for example, at least a portion of a one-time password generated by a hardware or software authentication token.

In a given illustrative embodiment, the information available from the authentication token is obtained by generating a request for that information, and receiving a response to the request. The request may be generated by, for example, a host device, gaming server or other element of the gaming system. The user is allowed to take the particular action in the game if the response contains the requested information available from the authentication token. Other embodiments allow the information available from the authentication token to be obtained by the host device, gaming server or other element of the gaming system without the need for such an element to directly request such information.

The information available from the authentication token may comprise one or more information elements to be entered by the user based at least in part on corresponding indications provided by the authentication token. As a more particular example, the one or more information elements may comprise a sequence of user interface commands to be entered by the user in a manner indicated by the authentication token.

It is also possible that the information available from the authentication token may comprise non-numerical information provided by the authentication token, such as one or more symbols generated by the authentication token.

In another aspect of the invention, the gaming system is configured to present to the user via a user interface a number of selectable options one of which corresponds to the information available from the authentication token. The information available from the authentication token is obtained in such an arrangement by receiving an indication of user selection of a particular one of the selectable options.

In a further aspect of the invention, the information available from the authentication token is obtained based at least in part on the user manipulating an input device of the system in a particular manner. For example, the input device may comprise a hand-held wireless controller of the gaming system, with the information being obtained responsive to the user gesturing with the hand-held wireless controller. As another example, the input device may comprise the authentication token itself, with the user interacting with a touchpad or other input mechanism of the token. These and other input devices may be used to allow the user to control selection of a particular one of a number of selectable options relating to the provision of authentication information.

The obtained information may comprise, for example, information indicative of previous interaction between the authentication token and another system or device, or information indicative of a location of the authentication token.

A host device, gaming server or other element of a gaming system may provide information indicative of identity of the user to an external server in conjunction with allowing the user to take the particular action.

DETAILED DESCRIPTION

The present invention will be described herein with reference to exemplary authentication tokens and associated gaming systems. It is to be appreciated, however, that the invention is not restricted to use with the particular illustrative token and system configurations shown. Although these configurations are particularly well suited for use with authentication tokens that generate tokencodes in the form of time-based or event-based one-time passwords (OTPs), it is to be appreciated that the invention is more broadly applicable to tokens that provide other types of authentication information.

The term "game" as used herein is intended to be broadly construed, so as to encompass, for example, not only traditional video games, but also other simulated environments such as those involving virtual worlds, role-playing, training, interviewing, etc.

As will be described, the present invention in one or more illustrative embodiments provides enhanced authentication functionality in a gaming system by configuring the system to incorporate authentication token support for the granting of various privileges or otherwise allowing particular actions to occur during a game in progress. An authentication process of this type may be referred to herein as an in-game authentication process, as it generally occurs while the game is already in progress for a given user, as opposed to occurring in conjunction with login time or other initial access of that user to the game.

Figure 1:
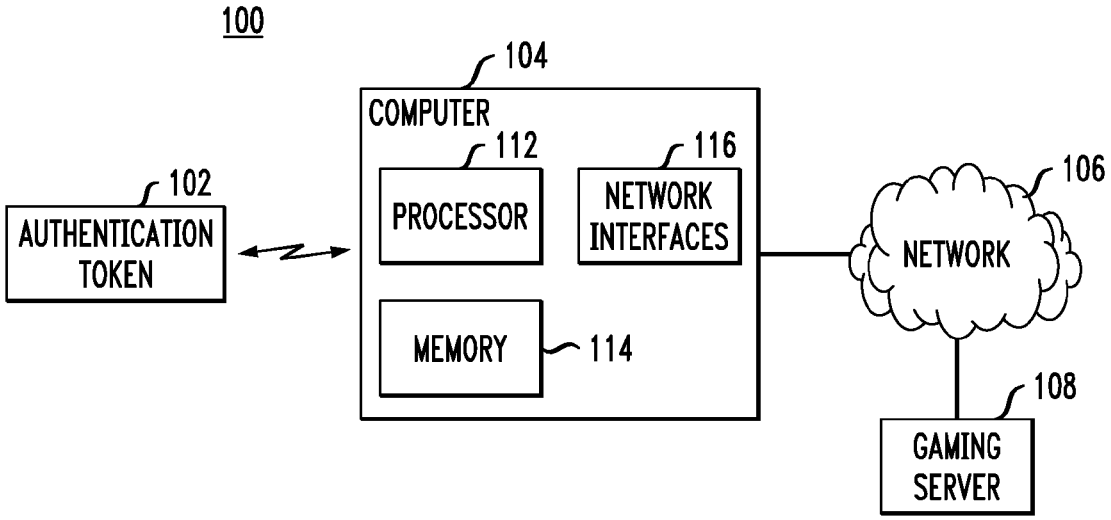
FIG. 1 is simplified block diagram showing one example of a gaming system with authentication token support in an illustrative embodiment of the invention.

FIG. 1 shows an example of a gaming system 100 which includes an authentication token 102, a host device 104, a network 106 and a gaming server 108. The authentication token is configured to generate OTPs or other tokencodes in a conventional manner. Such tokencodes may be presented to a user via a display of the token, such that the user can manually enter a given displayed tokencode into a user interface of the host device 104. Alternatively, a given tokencode may be communicated directly from the authentication token to the host device via a wired or wireless connection between the token and the host device. By way of example, the authentication token may be configured to communicate with the host device 104 via a wired connection such as a USB interface, or via a wireless connection such as a wireless USB, Bluetooth, IEEE 802.11, RFID or infrared connection.

The authentication token 102 may be, for example, a time-based authentication token, an event-based authentication token, a challenge-response token, a hash-chain token, or a hybrid token that incorporates multiple such capabilities, such as a hybrid time-based and event-based token. A given authentication token may be a connected token or a disconnected token, or one capable of operating in both connected and disconnected modes. The disclosed techniques can be adapted in a straightforward manner for use with these and other types of authentication tokens. For example, alternative embodiments may utilize a software authentication token that is implemented within the host device or another processing device of the system.

Additional details of exemplary conventional authentication tokens can be found in, for example, U.S. Pat. No. 4,720,860, entitled "Method and Apparatus for Positively Identifying an Individual," U.S. Pat. No. 5,168,520, entitled "Method and Apparatus for Personal Identification," and U.S. Pat. No. 5,361,062, entitled "Personal Security System," all of which are incorporated by reference herein.

Another example of a known authentication token suitable for use in conjunction with embodiments of the present invention is the RSA SecurID® user authentication token, commercially available from RSA, The Security Division of EMC Corporation, of Bedford, Mass., U.S.A.

The host device 104 may comprise a desktop or portable personal computer, mobile telephone, personal digital assistant (PDA), wireless email device, workstation, kiosk, television set-top box, gaming console, or any other information processing device that can be configured to support user interaction in a gaming system.

The host device 104 is shown in this embodiment as comprising a processor 112, a memory 114 and one or more network interfaces 116. Such elements may comprise otherwise conventional elements of the information processing devices noted above, suitably modified to operate in accordance with the invention. For example, the host device may be configured to store one or more software programs in memory 114 for execution by processor 112 in providing at least a portion of an in-game authentication process. Software running on the host device is an example of what is also referred to herein as client software.

It was indicated above that authentication token 102 need not take the form of a typical stand-alone hand-held hardware authentication token. Moreover, a given hardware authentication token may be incorporated into another processing device, such as a computer, mobile telephone, etc. In this type of implementation, the host device and the authentication token may be combined into a single processing device that communicates with the gaming server 108 over the network 106.

The network 106 may comprise, for example, a global computer network such as the Internet, a wide area network (WAN), a local area network (LAN), a satellite network, a telephone or cable network, or various portions or combinations of these and other types of networks.

In the system 100, the gaming server 108 operates in conjunction with host device 104 to provide an online game to a user associated with the authentication token 102. The gaming server may be associated with a game service provider, and may incorporate authentication functionality similar to that provided by a conventional authentication server. Alternatively, the gaming server may communicate with such an authentication server over the network 106. Conventional aspects of authenticating tokencodes are familiar to those skilled in the art, and will therefore not be described in further detail herein. The present invention can make use of any of a wide variety of such conventional authentication arrangements.

It is to be appreciated that a given embodiment of the system 100 may include multiple instances of authentication token 102, host device 104, gaming server 108, and possibly other system components, although only single instances of such components are shown in the simplified system diagram for clarity of illustration. Also, as indicated previously, other embodiments may combine certain system elements, such as the authentication token and the host device. It is also possible to eliminate, modify or replace other system elements. For example, a given embodiment of the invention may involve the use of a host device comprising a stand-alone personal computer or gaming console, with the game being provided locally at the computer or console rather than online via a gaming server. In such an arrangement, the gaming server may be eliminated, and the host device can, for example, communicate directly over network 106 with an authentication server for purposes of authenticating tokencodes or other information obtained from the authentication token. Also, a given "server" as that term is used herein may comprise a single computer, processing platform or other processing device, or a combination of multiple such devices.

Figure 2:
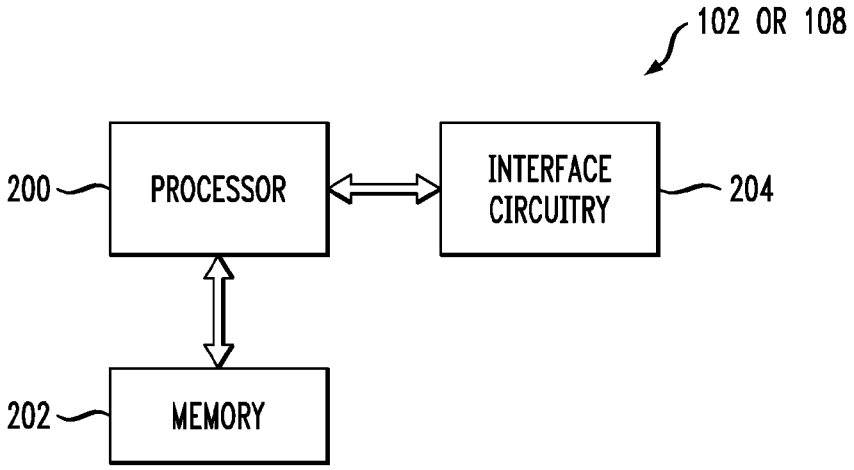
FIG. 2 shows a more detailed view of one possible implementation of a processing device of the FIG. 1 system.

Referring now to FIG. 2, a more detailed illustrative implementation of a given processing device of the system 100 is shown. The processing device as shown generally in FIG. 2 may be viewed as representative of the authentication token 102 or the gaming server 108. In this illustrative embodiment, the processing device comprises a processor 200 coupled to a memory 202. Thus, authentication token or gaming server portions of a given in-game authentication process as disclosed herein may be implemented in the form of software that is executed on a processing device comprising a processor coupled to a memory. Processor 200 is also coupled to interface circuitry 204.

If the processing device of FIG. 2 is viewed as representative of authentication token 102 or a portion of such a token, the interface circuitry 204 may comprise, for example, circuitry for interfacing the authentication token 102 to the host device 104 via a wired or wireless connection in the case of a connected token, or circuitry for generating a visual or audible presentation of a given generated tokencode in the case of a disconnected token. Thus, the interface circuitry may include, for example, wired or wireless interface circuitry such as USB, Bluetooth, IEEE 802.11, RFID or infrared circuitry, or one or more speakers, displays and associated drivers, in any combination.

If the processing device of FIG. 2 is viewed as representative of gaming server 108 or a portion of such a server, the interface circuitry 204 may comprise a network interface card or other type of network interface circuitry configured to permit the gaming server to communicate over the network 106. In other embodiments, such interface circuitry may be configured to allow the gaming server to communicate directly with the host device 104, or directly with the authentication token 102.

The various elements 200, 202 and 204 of FIG. 2 may be implemented in whole or in part as a conventional microprocessor, microcontroller, digital signal processor, application-specific integrated circuit (ASIC) or other type of circuitry, as well as portions or combinations of such circuitry elements. As indicated previously, portions of an in-game authentication process in accordance with a given illustrative embodiment of the invention can be implemented at least in part in the form of one or more software programs that are stored at least in part in the memory 202 and executed by processor 200. Memory 202 may also be used for storing information used to perform tokencode generation, authentication or other operations associated with an in-game authentication process.

Figure 3:
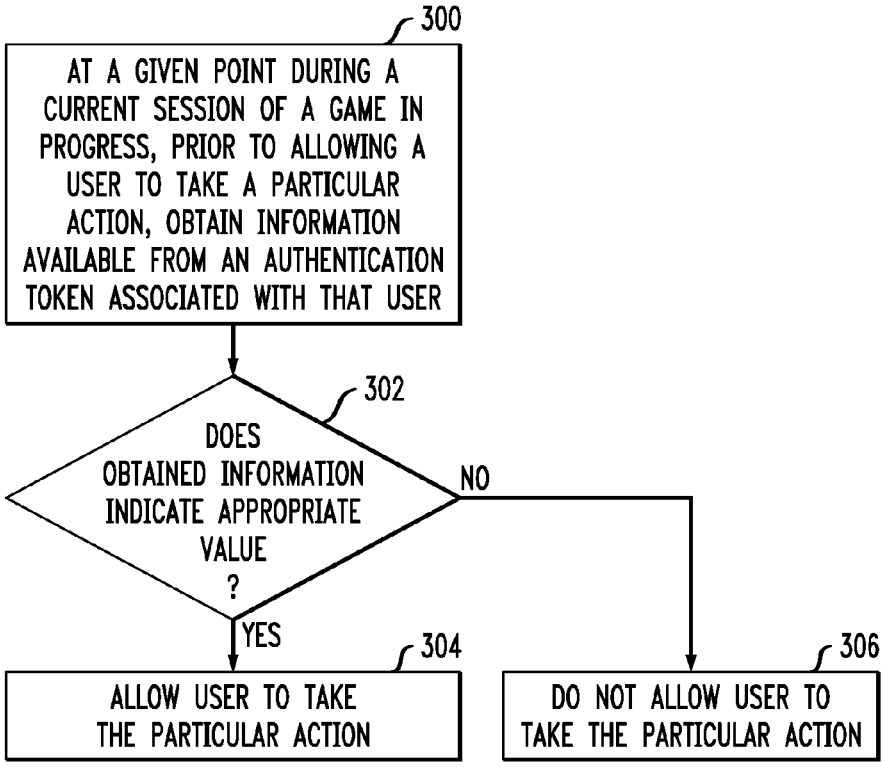
FIG. 3 is a flow diagram of an in-game authentication process implemented in the system of FIG. 1 in an illustrative embodiment of the invention.

Techniques for providing in-game authentication in the gaming system 100 using authentication token 102 will now be described in greater detail with reference to the flow diagram of FIG. 3. Generally, in such a technique, a user is first granted access to participate in a current session of a given game. This initial access may be provided, for example, via a conventional user login process. The game may be an online game provided by interaction between gaming server 108 and host device 104 over network 106, and may involve numerous other users that access the system via other host devices. The given game is characterized as comprising multiple sessions, where the term "session" is intended to be construed broadly so as to encompass, for example, a separately-identifiable portion of the game. The process in this embodiment involves steps 300 through 306 as shown in the figure.

As indicated in step 300, at a given point during a current session of a game in progress, prior to allowing a user to take a particular action in the game, information available from an authentication token associated with that user is obtained. The user is assumed to have been previously granted access by the system to participate in the current session. Thus, the particular action is integrated into the game as a part of the game itself, and does not constitute an initial access to the game or its current session. The particular action may be, for example, casting a spell, opening a locked door or chest, obtaining an item, achieving a specified credential, entering a designated area, or otherwise accessing a particular element within a virtual world provided by the game in progress.

In step 302, the system determines if the information obtained from the authentication token has an appropriate value. For example, the system may determine if an OTP obtained from the authentication token is within a set of acceptable OTPs associated with the particular action. If the obtained information indicates an appropriate value, the user is allowed to take the particular action within the game in step 304. Otherwise, the user is not permitted to take the particular action, as shown in step 306.

The information available from the authentication token 102 may be obtained in a given embodiment by the host device 104 or gaming server 108 requesting that information from the user responsive to the user attempting to take the action in question. By way of example, the gaming server or host device may generate a request for the information available from the authentication token, receive a response to the request, and allow the user to take the particular action in the game if the response contains the requested information available from the authentication token.

In other embodiments, the user may provide authentication information available from the token without explicitly being asked for it. For example, the user may arrive at a door within the game and need to say a special word. This request for the word is implicit in the rules of the game but there is no specific prompt for it. In another example, the user may simply press a button on a controller to move from one place to another, with the necessary authentication provided to the game along with the movement command. Again, there would be no explicit request.

Also, acceptable authentication information may include other choices besides what is available at a particular moment from the token. For example, multiple tokencode values falling within a given specified window may be considered appropriate values for a given instantiation of step 302 in the FIG. 3 process.

The above-described process advantageously incorporates authentication token support into the game itself, in a culturally-appropriate manner that provides a mechanism for achieving not only user authentication but also assurances that an actual human user rather than automated script is playing the game.

A number of more specific examples of in-game authentication processes implementable in the FIG. 1 system or other types of gaming systems will now be described.

In one simple example, a wizard character in a given virtual world or other type of game may be required to enter an OTP from an authentication token of the corresponding user in order to cast a spell. Alternatively, the system may be configured such that only those spells up to a certain level can be cast without entry of an OTP.

If the game offers private clubs or guilds, an OTP could be required in order to enter the private property of the guild. More and more virtual environments are now offering the equivalent of private property. These private spaces can be used as corporate collaboration tools, as a virtual gaming environment offers a far more user friendly and fun way to interact with business colleagues than traditional staid business-productivity applications. The token could be used to secure access to teleconferences, meetings, and lectures conducted in the virtual world, as well as repositories of digital files. Many in-game communities offer the equivalent of a public bulletin board, or weblog function. Access control to these collaboration services could likewise be enabled only upon successful authentication including the presentation of a correct tokencode. Schools offering distance-learning opportunities in a virtual world could use the token to build a private community keeping outsiders away from courseware and from undesired interaction with students. Virtual worlds offer an especially attractive platform for skills training. While flight simulators have long been established to train pilots, all manner of employees could be trained in a cost effective manner in a virtual world. From restaurant waitstaff to prison guards, electricians to railroad engineers, employees could be trained in a virtual environment simulating real working conditions with access control provided by an authentication token. These and other types of virtual worlds are considered to be examples of "games" as that term is used herein.

Some games like EverQuest, World of Warcraft and Second Life can support thousands or millions of simultaneous users. These numbers far outstrip the attendance of even the largest real-world industry trade shows. It is only natural, then, that industry trade shows and committee meetings will take place in virtual worlds. Of course, these types of events are quite expensive to produce and therefore access to premium content like proceedings and audio casts of speakers must be restricted to paying attendees. These attendees could be provisioned with an authentication token by mail or otherwise, in advance of the conference, and admitted to the virtual conference only on presentation of the correct tokencode.

In embodiments involving time-based authentication tokens, the fact that the digits of the OTP change over time means that the token and server both have a time-of-day clock. A similar form of synchronization based on event counters is utilized with event-based tokens. One can use these and other forms of synchronization to enhance gameplay while increasing security. For example, the token could operate like a slot machine: since it is after all a random digit generator, from time to time certain patterns will randomly appear on the display. In certain cultures, the number seven is considered lucky while in others it is the number eight. So one could design a game where the user has an incentive to enter his or her OTP. If the display contains three sevens, for instance, the user could receive some amount of in-game currency, or the ability to increase some of his or her character's attributes such as the ability to cast more powerful spells.

The token could be fitted with a light emitting diode (LED) or other type of indicator to indicate that a special tokencode has been generated.

Modern role-playing games are complicated things: often a character is faced with a grand quest to complete along with several concurrent sub-quests. Many of these sub-quests are very simple. To help a player in fighting battles or managing inventory, many games will offer automated "pets." In part to discourage players from automating tasks on their own, some games offer simple non-player characters which accompany a player. These virtual pets often need to be fed in order to remain happy, healthy, and strong. So from time to time a player will be advised that feeding time has arrived, or that pet food can be found lying on the ground nearby. Using the time synchronization noted above, the token could tell the player when the virtual pet needs attention. At these times, by entering the displayed tokencode, the player can care for the virtual pet. Observe that the token does not need to be notified if the pet has been cared for or not. It simply chooses random times to ask the player to care for the pet.

Feeding one's pet may be viewed as one example of what is commonly referred to as a microgame. These short, simple games are often provided as a filler of time, especially when the user is asked to wait for a larger game to finish loading. Such games can be configured using the techniques of the invention to require information available from an authentication token. For instance, the user could be asked to solve some puzzle involving digits displayed on the token. One simple example is for the gaming server to ask a multiple-choice question about the digits. The server could ask: which of the following tokencodes is currently displayed? The user responds by clicking appropriately. To be made more appealing to the user, this microgame could be made culturally appropriate. For an outerspace themed game, the user could pilot a spacecraft into a particular area depending on the digits displayed by the token. For a medieval themed game, this action could be taken by the server before any potentially high risk transaction, such as giving away a valuable item, is permitted.

Other possibilities include microgames like Sudoku using the digits of the token as the starting position. In a variant of the above-noted slot machine example, a user could enter the displayed digits to receive a virtual lottery ticket.

A time synchronized token could figure in other quests as well. A user having a character with a lock picking skill could have the character enter a tokencode to unlock a door or chest. To reduce the burden of actually typing in the tokencode, the server could instead display three or four alternatives. The user simply has to pick the alternative that is currently displayed on his or her token.

As indicated previously, the techniques of the present invention are not limited to an authentication token that displays digits. Authentication token 102 could be configured to display any number of things from colors to letters to playing cards to magical symbols to short words which could be input to the client software by the user. These displayed items, especially playing cards, could be incorporated into microgames to make the experience fun and culturally appropriate. A user could thus authenticate simply by playing a hand of poker where the poker cards are displayed on the token.

It is also possible to implement the authentication token as a virtual artifact within the game itself. This is one example of a type of software authentication token. As more people become accustomed to the online game experience as a metaphor to experience the Internet, we can expect more games to offer portals to the users to allow them to conduct ordinary business. Already, one can order pizza from Pizza Hut from within the game EverQuest. As time goes on, we can expect that people will gain the ability to conduct banking and shopping transactions using the online game interface. In order to conduct these transactions with disparate servers securely, we can leverage the fact that the user has already authenticated to a game service provider, making the service provider an identity broker who can vouch for the mapping between in-game and real-world identities. So a virtual token, or other type of software authentication token, whether explicitly displayed to the user or not, could be used to authenticate the user to an out-of-world server like a bank or retailer. Of course, like everything else in the game, the virtual token is a software simulation. But it provides legitimate passwords or other tokencodes nonetheless. To establish that out-of-world connection, the tokencode from the virtual token could be sent by the gaming server to an authentication server. The use of continuous authentication in a fun and culturally appropriate way provides the second factor needed for this two-factor authentication for the bank or retailer. The bank or retailer can trust that the user was authenticated initially by the game server, perhaps using some combination of hardware token, software token, password, biometrics, life questions, risk-based analytics, etc.

One of the most popular enterprise uses of virtual worlds is for corporate recruiting. Companies can establish a human resources presence in an online community to attract suitable candidates. By beginning a relationship with a potential new hire in a virtual world, one runs the risk of identity theft or simple impersonation. So at the time of submitting a resume, a potential recruit could be provisioned with a virtual authentication token, used to protect both company and potential recruit through the stages of the hiring cycle. For example, we can expect that initial rounds of interviewing will take place in a virtual world. To ensure consistent identity, in conjunction with a given interview session, the potential recruit would need to provide a tokencode from the virtual authentication token. Such a virtual token may be viewed as another example of a software authentication token.

Similarly, actions in the real world can be made to have virtual consequences. For example, as part of a sales promotion, visiting a particular real-world clothing store and trying on some apparel could unlock virtual content for one's character, such as in-game clothing. Securing access to content in this way requires a similar coordination between content providers and game operators. A consumer could take his or her authentication token to an industry trade show, and using a special kiosk, could authenticate to the game service provider. Because the consumer has authenticated from that kiosk, special in-game content could be unlocked, like the proceedings of the conference or the ability to access video or audio recordings of in-game or real-world conference speakers. The consumer could be required to authenticate from a number of real-world kiosks to complete a sort of treasure hunt. Such arrangements are examples of proof-of-interaction embodiments in which a gaming server or other gaming system element requests or otherwise obtains information providing evidence of previous interaction between the authentication token and another system or device.

This type of proof-of-interaction information may be obtained by equipping the token with a short-range data interface, such as USB, wireless USB, Bluetooth, IEEE 802.11, RFID, infrared, etc. By merit of close proximity, the token and kiosk could exchange authentication information so that the token could later prove that it was within close proximity of the kiosk. This authentication information could take the form of a key exchange, tokencode seed, pairing protocol, identity or configuration attestation, or digitally-signed statement delivered over the short-range data interface. At a later time, the token could present part of, or a derivative of this authentication information to the game service provider to prove that it previously interacted with the kiosk, and unlock access to particular areas of the game, or other content. For its part, the game service provider may present this authentication information such as a tokencode to the original kiosk, or its surrogate, for verification.

Other embodiments could obtain information from an authentication token that includes evidence of the authentication token's location. In-game authentication applications similar to the proof-of-interaction examples provided above could be implemented using a proof-of-location approach. Again, such information can be obtained from the authentication token via a short-range data interface.

For games played on dedicated consoles like the Sony PlayStation and Nintendo GameCube which typically lack keyboards in favor of game controllers, the token could display a sequence of buttons to press. Or the game could display a keypad on the screen where the user "clicks" on the correct digits with the game simulating the functionality of a mouse using the directional keypad or control stick for movement. Now that some handheld consoles like the Nintendo DS come with touch screens and microphones, we have an array of different input options.

In other embodiments, the operation of the authentication token could be made transparent to the user. For example, at selected intervals, a remote gaming server could request a tokencode or provide a challenge. Virtual world client software could pass these along to the token and similarly relay the results.

Assuming we have such a token, various methods may be used to gain confidence that a human is present. One example is biometrics. Many biometric sensors include provisions to determine that a sample is being collected from a live person. These include fingerprint sensors that also detect heat and heartbeat. However, this interaction could impact the user experience, and alternative approaches may be preferred.

For example, many spells require particular artifacts like a ring or magic wand. To cast a spell, one's character could be required to place their finger on the stone of the ring. To cause this in-game action, the user could place their finger on a fingerprint sensor. Appropriate visuals could be displayed on the screen to enhance the illusion that placing one's finger on a fingerprint sensor unleashes a great deal of power.

Speech recognition capabilities may also be provided in a given embodiment of the invention. For example, a decision as to whether or not to allow a user to take a particular action in a game may be based at least in part on the user speaking a certain phrase into a microphone of the system in a particular manner.

Popular gaming consoles like the Nintendo Wii now offer motion-sensing and orientation-aware controllers. The most common use of this motion-sensing capability is to cause one's character to swing a bat, throw a ball, or to perform another kinetic task, while orientation sensing is used to "point" directly at the screen, such as when firing a gun, or selecting items from a menu. In an aspect of the invention, these types of gestures may be used to cause the release of authentication information. In one embodiment, a software authentication token is used with an ordinary game controller. Only when the controller reports a certain gesture, such as the signing of one's name, the "secret handshake" of one's online guild, or other special flourish, will the authentication token release a tokencode. In another embodiment, a physical authentication token is outfitted with accelerometers, infrared receivers, or other motion-sensing devices. When the user gestures with the token in a certain way, a tokencode is released, perhaps by displaying on the token or computer screen, or perhaps over a wired or wireless interface.

This approach allows a single token to choose from one of several streams of tokencodes. By gesturing in a particular way, the user can request a tokencode for one of a number of particular servers. Or alternately, one stream of tokencodes corresponding to one gesture could authorize low-value transactions, like purchasing mundane items from an in-game shop, while another stream of tokencodes corresponding to a different gesture could authorize a high-value transaction such as giving away an expensive virtual sword. Similarly, the amplitude or other characteristic of a particular gesture could be used to provide age verification. For example, children's forearm muscles are not as well developed as those of adults. For that reason, an adult can swing a controller as if it were a baseball bat with much higher velocity than a child could. Only those who could swing a controller at a particular speed would be permitted access to certain areas of an online game.

It is also possible for information available from the authentication token to be obtained by the user manipulating an input device of the system in a particular manner. For example, a user could press a touch screen provided on the token. Such arrangements could also be used to select from one of a number of possible tokencodes, to selectively authorize either high or low value transactions, or to select among a number of different servers.

When adopting a biometric approach, care should be taken regarding various ways that people use the characters in a given game. For example, members of the same household will sometimes share a character. Other times, a user may want to sell his or her character to another. None of these scenarios present major difficulties, but they should be taken into account in the system design.

Web cameras can be used in addition to or in place of traditional biometrics. For example, low resolution video cameras can be used to implement rudimentary facial recognition. These or other simple computer vision techniques could indicate if a person is present or not. Taking a multivalent approach allows us to make use of whichever peripherals a user happens to have: if a web camera is present, we can use that. Similarly with fingerprint scanners, or even microphones into which a user could speak some magical incantation which is processed by a speaker identification algorithm.

Other peripherals such as mobile telephones may be used. Today's mobile phones offer rich color displays which go beyond the traditional eight digits displayed by a token. A mobile phone also offers rich connectivity including Bluetooth connection to a PC and remote connections using, for example, Short Message Service (SMS) and Internet access over cellular protocols.

These richer displays and connectivity options allow the mobile phone to serve as a full-fledged adjunct to the game experience as presented on a PC screen or other user interface display. For example, the virtual pets noted above could be entirely hosted on the mobile phone. The pet could have its needs met by the user manipulating the phone interface. In addition, the pet could act as a portal into the virtual world while one is away from a PC. It could, for instance, relay messages sent by game players and provide information on in-game events such as updates on the progress of tasks undertaken by a player's group or guild.

Beyond hosting virtual pets, a mobile phone display could be used to provide extra context to the user, such as available items, hit points, or magic points. Beyond these, the phone could act as an astronomical guide to tell the user which spells or spell-alignments may be the most powerful at any given time.

If no appropriate peripherals are present, we can present the user with a so-called "captcha" which is typically a series of distorted letters against a grid which is presumably easy for a human to read but difficult for computer vision applications. It may seem more difficult to integrate this approach in a culturally appropriate manner, but one can imagine a wizard equipped with magical scrolls whose contents change every time and which comprise the magical incantation to cast the spell.

As indicated previously, embodiments of the invention can be implemented without the use of hardware authentication tokens. Software simulations of hardware tokens are known in the art. Typically, in such an arrangement one uses a PC, mobile telephone, PDA or other processing device to run computer code that mimics the behavior of a hardware token. In an aspect of the invention, portals can be provided from the virtual world which allow for typical Internet tasks like banking. To provide the authentication to allow these applications, one could have a software authentication token hosted on a gaming server or other gaming system element and available for a player to use when accessing external sites from within the game. This is one example of an arrangement in which the particular action in the game causes the gaming system to provide evidence of the user's identity to an external server. The gaming server thus serves as an authentication broker for external sites rendered in-game.

It should be noted that the system and processing device configurations shown in FIGS. 1 and 2 are presented by way of illustrative example only. A given embodiment of the invention may comprise an otherwise conventional gaming system, online or otherwise, implemented utilizing one or more processing devices such as the above-noted PCs, gaming consoles, PDAs, mobile telephones, servers, etc. A given such processing device will generally include at least one processor and at least one memory. The one or more memories can be used to store program code for implementing at least a portion of at least one of the techniques described above, with such program code being executed by the processor(s) of the processing device. Conventional aspects of such processing devices as configured to support gaming system applications are well known, and those skilled in the art will be able to modify these devices in a straightforward manner to implement the techniques disclosed herein.

Figure 4:
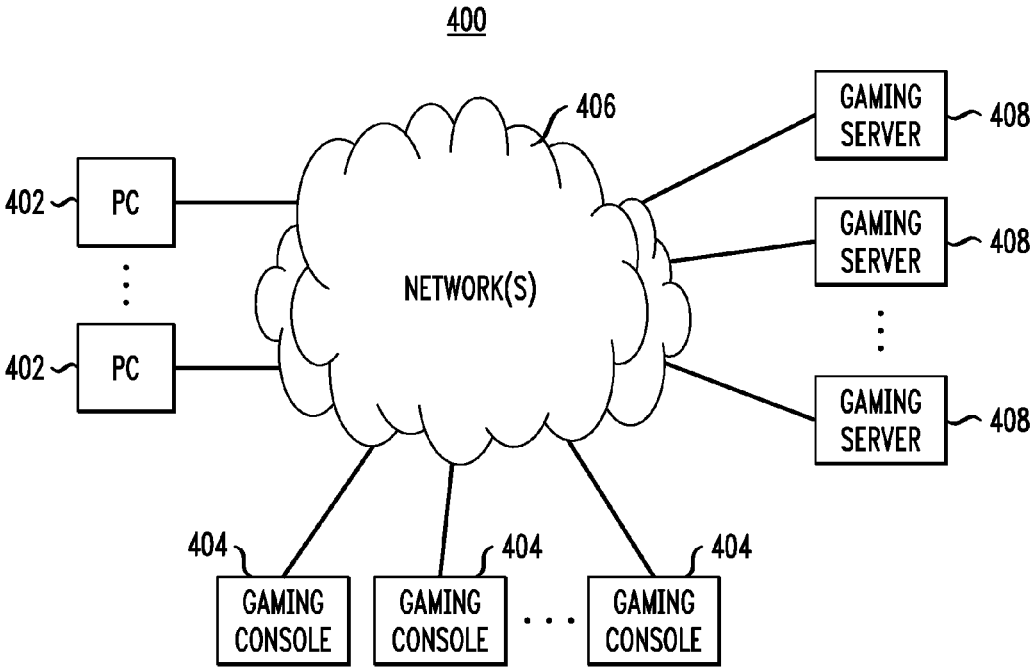
FIG. 4 shows another example of a gaming system with authentication token support in an illustrative embodiment of the invention.

As was described in conjunction with FIG. 1 above, an online gaming system configured in accordance with an embodiment of the invention may comprise multiple processing devices which are interconnected over a network such as the Internet. Another example of such a system is gaming system 400 shown in FIG. 4. In this system, a potentially large number of PCs 402 and gaming consoles 404 communicate with gaming servers 408, over the Internet or other types of network(s) 406 in any combination, in implementing a given online game of the type described herein.

It was mentioned above that certain embodiments of the invention can utilize a conventional hardware or software authentication token such as the above-noted OTP hardware authentication token with a visual display. For example, a gaming system can be configured such that the game itself periodically requests information regarding the current tokencode, as was previously described. As another example, a software authentication token can be incorporated into the game itself, as a virtual artifact or other controllable object made accessible to a given participant, again as previously described. Numerous alternative configurations are possible, utilizing a wide variety of other types of authentication tokens, as will be readily appreciated by those skilled in the art.

The above-described embodiments, although particularly well suited for use in online gaming systems, can be adapted for use in other types of gaming systems, including, by way of example, stand-alone gaming systems which do not require online connectivity, or those that restrict membership to users on a corporate LAN or other enterprise network.

It should again be emphasized that the above-described embodiments of the invention are presented for purposes of illustration. Many variations and other alternative embodiments may be used. For example, the particular configuration of system and device elements shown in FIGS. 1 and 2, and the in-game authentication process steps as shown in FIG. 3, may be varied in other embodiments. Moreover, the various simplifying assumptions made above in the course of describing the illustrative embodiments should also be viewed as exemplary rather than as requirements or limitations of the invention.

What is claimed is:

1. A method of providing authentication functionality in a gaming system, the method comprising the steps of:

responsive to a user attempting to take a particular action during a current session of a game in progress, the user having previously been granted access by the system to participate in the current session, obtaining information available from an authentication token associated with said user prior to allowing said user to take the particular action in the game; and allowing the user to take the particular action in the game based on the obtained information;

wherein the obtained information comprises information indicative of a location of the authentication token; and wherein the steps of obtaining information and allowing the user to take the particular action are at least in part performed by a processor.

2. The method of claim 1 wherein the obtaining and allowing steps further comprise the steps of:

generating a request for the information available from the authentication token;

receiving a response to the request; and allowing the user to take the particular action in the game if the response contains the requested information available from the authentication token.

3. The method of claim 1 wherein the allowing step further comprises allowing the user to take the particular action in the game if the obtained information is among a set of currently acceptable values for said action.

4. The method of claim 1 wherein the authentication token comprises a hardware authentication token.

5. The method of claim 1 wherein the authentication token comprises a software authentication token.

6. The method of claim 1 wherein the information available from the authentication token comprises at least a portion of a one-time password generated by the authentication token.

7. The method of claim 1 wherein the information available from the authentication token comprises one or more information elements to be entered by the user based at least in part on corresponding indications provided by the authentication token.

8. The method of claim 7 wherein the one or more information elements comprise a sequence of user interface commands to be entered by the user in a manner indicated by the authentication token.

9. The method of claim 1 wherein the information available from the authentication token comprises non-numerical information provided by the authentication token.

10. The method of claim 9 wherein the non-numerical information provided by the authentication token comprises one or more symbols generated by the authentication token.

11. The method of claim 1 wherein the system presents to the user via a user interface a number of selectable options one of which corresponds to the information available from the authentication token.

12. The method of claim 11 wherein the step of obtaining the information available from the authentication token comprises receiving an indication of user selection of a particular one of the selectable options.

13. The method of claim 1 wherein the particular action comprises accessing a particular element within a virtual world provided by the game in progress.

14. The method of claim 1 wherein the information available from the authentication token is obtained based at least in part on the user manipulating an input device of the system in a particular manner.

15. The method of claim 14 wherein the input device comprises a hand-held wireless controller of the gaming system.

16. The method of claim 14 wherein the input device comprises the authentication token itself.

17. The method of claim 14 wherein the manner in which the user manipulates the input device is operative to control selection of a particular one of a number of selectable options.

18. The method of claim 1 wherein the obtained information comprises information indicative of previous interaction between the authentication token and another system or device.

19. The method of claim 1 wherein an element of the gaming system provides information indicative of identity of the user to an external server in conjunction with allowing the user to take the particular action.

20. A non-transitory processor-readable storage medium storing one or more software programs, wherein the one or more software programs when executed by the processing device implement the steps of:

responsive to a user attempting to take a particular action during a current session of a game in progress, the user having previously been granted access by the system to participate in the current session, obtaining information available from an authentication token associated with said user prior to allowing said user to take the particular action in the game; and allowing the user to take the particular action in the game based on the obtained information;

wherein the obtained information comprises information indicative of a location of the authentication token.

21. A processing device for use in a gaming system, the processing device comprising:

a processor; and a memory coupled to the processor;

wherein the processing device is configured such that, responsive to a user attempting to take a particular action during a current session of a game in progress, the user having previously been granted access by the system to participate in the current session, the processing device obtains information available from an authentication token associated with said user prior to allowing said user to take the particular action in the game, the processing device being further configured to allow the user to take the particular action in the game based on the obtained information, the obtained information comprising information indicative of a location of the authentication token.

22. The processing device of claim 21 wherein the authentication token comprises a software authentication token.

23. The processing device of claim 21 wherein the processing device comprises a gaming console of the system.

24. The processing device of claim 21 wherein the processing device comprises a gaming server of the system.

25. The processing device of claim 21 wherein the processing device comprises a host device configured for communication with a gaming server over a network.

26. A gaming system comprising:

a processing device; and an authentication token;

wherein the processing device is configured such that, responsive to a user attempting to take a particular action during a current session of a game in progress, the user having previously been granted access by the system to participate in the current session, the processing device obtains information available from the authentication token prior to allowing said user to take the particular action in the game, the processing device being further configured to allow the user to take the particular action in the game based on the obtained information, the obtained information comprising information indicative of a location of the authentication token.

27. The system of claim 26 wherein the authentication token comprises a hardware authentication token physically separate from the processing device.

28. The system of claim 26 wherein the authentication token comprises a software authentication token implemented on a device that is physically separate from the processing device.

29. The system of claim 26 wherein the processing device comprises one of a gaming server and a host device of the gaming system.

* * * * *